US006971642B2

(12) United States Patent
Carnell

(10) Patent No.: US 6,971,642 B2
(45) Date of Patent: Dec. 6, 2005

(54) SECURED THREADING NUT DECKING CLAMP AND METHOD FOR MAKING SAME

(75) Inventor: A. Boyd Carnell, Arlington, TX (US)

(73) Assignee: Metals USA Building Products, L.P., Houston, TX (US)

( * ) Notice: Subject to any disclaimer, the term of this patent is extended or adjusted under 35 U.S.C. 154(b) by 0 days.

(21) Appl. No.: 10/729,318

(22) Filed: Dec. 5, 2003

(65) Prior Publication Data

US 2004/0164476 A1 Aug. 26, 2004

Related U.S. Application Data

(60) Provisional application No. 60/431,502, filed on Dec. 6, 2002.

(51) Int. Cl.[7] ..... B25B 1/10

(52) U.S. Cl. ..... 269/249; 269/143; 29/257

(58) Field of Search ..... 269/249, 248, 269/143, 173, 181; 29/276, 257, 249

(56) References Cited

U.S. PATENT DOCUMENTS

| | | | | |
|---|---|---|---|---|
| 2,949,140 | A | 8/1960 | Larson | |
| 3,147,003 | A | 9/1964 | Johnson | |
| 4,155,206 | A | 5/1979 | Player | |
| 4,417,431 | A | 11/1983 | Commins et al. | |
| 4,476,659 | A | 10/1984 | Player | |
| 4,543,760 | A | 10/1985 | Barker | |
| 4,575,983 | A | 3/1986 | Lott, Jr. et al. | |
| 4,796,403 | A | 1/1989 | Fulton et al. | |
| 5,511,354 | A | 4/1996 | Eidson | |
| 5,586,378 | A * | 12/1996 | Smith | 29/257 |
| 6,257,565 | B1 * | 7/2001 | Houston et al. | 269/249 |
| 6,431,534 | B1 * | 8/2002 | Orosz et al. | 269/43 |
| 6,726,193 | B1 * | 4/2004 | Yates | 269/184 |
| 2004/0164476 | A1 * | 8/2004 | Carnell | 269/249 |

* cited by examiner

*Primary Examiner*—Lee D. Wilson
(74) *Attorney, Agent, or Firm*—Jackson Walker, LLP

(57) ABSTRACT

A decking clamp for use in an underhung roof system. A C-shape housing has opposed arms and a variable gap opening in a clamping cavity. A threaded retention nut is secured within two opposed slots in a front section of one of the opposed arms rearward of a partition wall. The retention nut will not fall out of the housing during use by an installer.

1 Claim, 2 Drawing Sheets

SECURED THREADING NUT DECKING CLAMP AND METHOD FOR MAKING SAME

This utility patent application claims priority to U.S. Provisional Application, Ser. No. 60/431,502, filed Dec. 6, 2002, now abandoned and which is incorporated herein for all purposes.

BACKGROUND OF THE INVENTION

The present invention relates to decking clamps used in underhung roof systems. Additionally, and more particularly, the present invention provides a method for manufacturing and assembling a decking clamp having a secured threading nut in the clamp.

Decking clamps are not new but rather well known in the art. Therefore, the present invention is a significant improvement in a very crowded art field. The current state of the art relating to such clamps and clamping systems includes U.S. Pat. Nos.: U.S. Pat. No. 2,949,140 (1960); U.S. Pat. No. 3,147,003 (1964); U.S. Pat. No. 4,155,206 (1979); U.S. Pat. No. 4,417,431 (1983); U.S. Pat. 4,476,659 (1984); U.S. Pat. No. 4,543,760 (1985); U.S. Pat. No. 4,575,983 (1986); U.S. Pat. No. 4,796,403 (1989); and U.S. Pat. No. 5,511,354 (1996).

Particularly pertinent in the prior art are Metal Building Components, L.P.'s Classic Canopy Clip and U.S. Pat. No. 6,257,565 B1 (2001) to Houston et al. The technical disclosure of U.S. Pat. No. 6,257,565 B1 is incorporated by reference herein for all purposes. While the Classic Canopy Clip does not utilize a threaded nut to retain and guide the clamping bolt, U.S. Pat. No. 6,257,565 B1 does teach and disclose a clamp having a removable threading nut resting within a single-slot, retention channel.

The present inventive clamp is a significant improvement in the art and allows for the more labor and cost efficient manufacture of the C-shaped clamp while ensuring that the threaded guiding and retaining nut is securely retained within the clamp housing. The improved clamp is made via a method which simplifies the assembly of the clamp. The improved design of the present invention ensures that when the clamp is being used in an underhung roof system, the nut does not become dislodged and fall out of the housing while the installer is attaching the clamp to the roofing panels. This relatively simple but significant advance in design solves a long-standing problem with the prior art. When the nuts of the prior art clamping devices slip from the housing, the installer must stop work on the clamping operation, secure the roof panel by alternative means, locate a replacement nut, insert the new nut into the housing and rethread the clamping bolt. All of this extra effort slows the assembly time for the roofing system increasing the overall cost for the construction, unnecessarily delaying project completion, and leading to considerable, unnecessary frustration of the installer.

DETAILED DESCRIPTION OF THE PREFERRED EMBODIMENT

Figure 1:
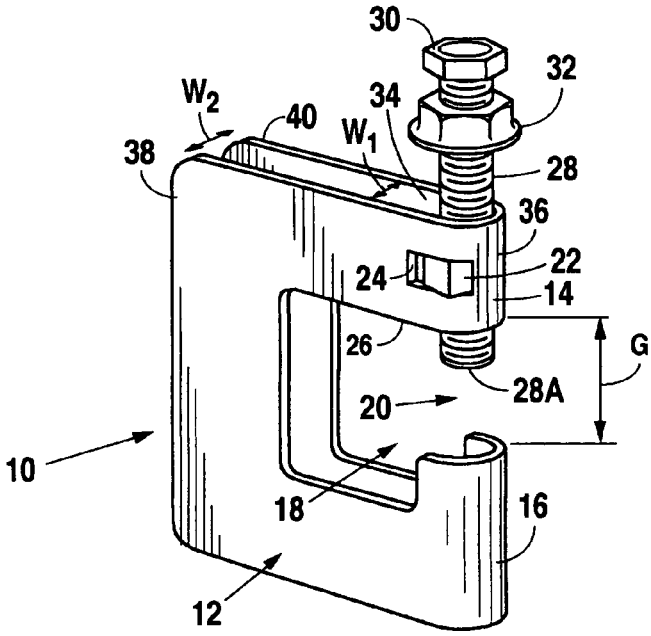
FIG. 1 is a top, front, right side perspective view of the present invention.
Figure 4:
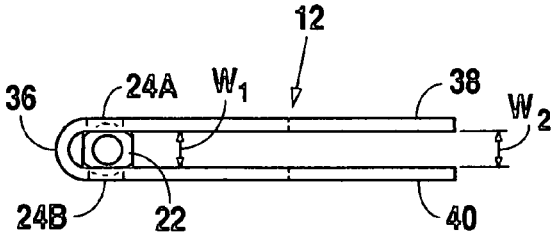
FIG. 4 shows a top plan view of the folded housing of the present invention with the secured retention nut in place.

Reference is made to the drawings of the present invention. FIG. 1 discloses an assembled decking clamp 10 having a substantially C-shaped housing 12 having first 14 and second 16 opposing arms and a clamping cavity 18 with a gap opening 20 in the cavity. A threaded retention nut 22 is secured within a two section or two opening notch 24 in a front section 26 of the first opposed arm 14. A threaded fastener member 28 having a rotation nut 30 and a stop plate 32 extends through a channel 34 formed in the folded clamp template 11. The fastener member 28 further threadingly passes through and is retained and guided by the retention nut 22. Nut 22 is secured within the two section notch 24 behind a front vertical partition wall 36 and held in place by the compression of side walls 38 and 40 to a gap width $W_1$ which is less than the outer diameter D of the nut 22. As may be seen in FIGS. 1 and 4, when side walls 38 and 40 are compressed the gap width may vary between the front $W_1$ to the back $W_2$. In some embodiments the front gap $W_1$ may be more than the back gap $W_2$ (or vice versa) but always the gap $W_1$ is less than the diameter D of the nut 22. The fastener member 28 may be rotated clockwise and counterclockwise to vary the width G of gap opening 20 between the head 28A of the fastener member 28 and the second opposed arm 16. It will be understood by one of ordinary skill in the art that the rotation of the fastener member 28 allows the clamp 10 to secure roofing panels to the appropriate frames and/or adjacent panels in an underhung roof system.

Figure 2:
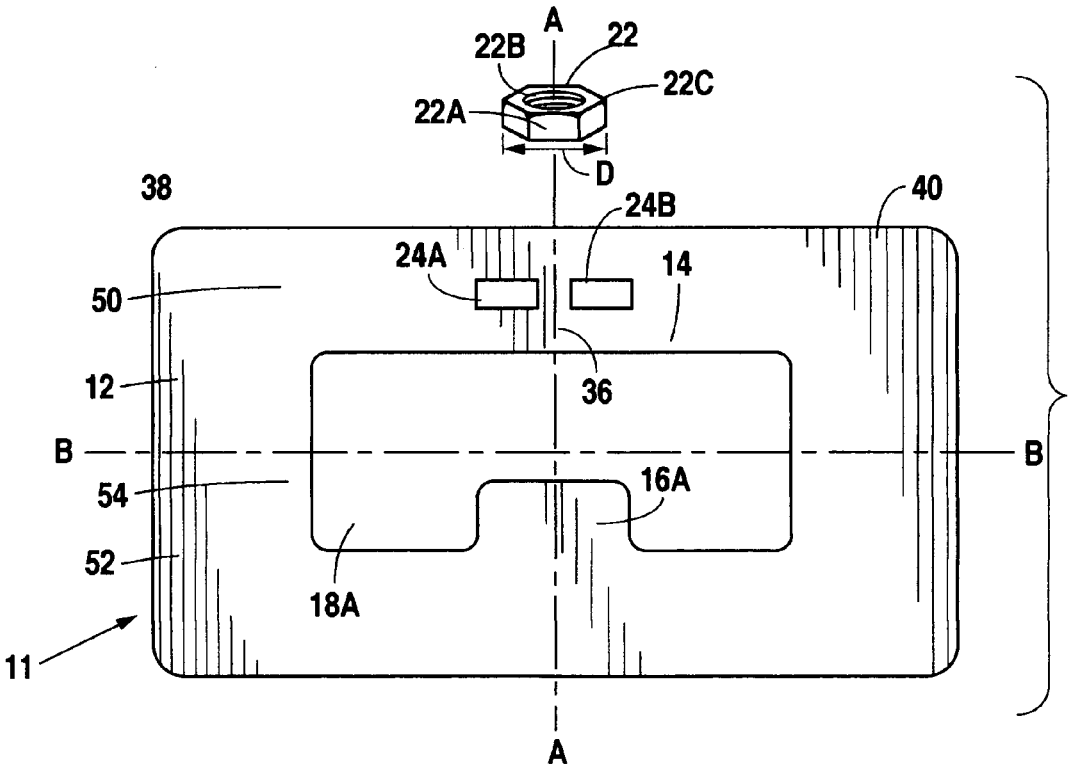
FIG. 2 is a front, elevation view of the template and retention nut (the nut is shown in perspective).

FIG. 2 illustrates a front elevation view of the generally planar template 11 of the present invention. The template may be composed of any composition which may be easily fabricated and bent or folded and retain the desired folded configuration. Such compositions may include steel, aluminum, metal alloys, high strength moldable plastics, and other functional equivalents. The template 11 is generally symmetrical about its transverse axis A and its longitudinal axis B. The transverse axis A divides the template into a right side wall section 34 and a left side wall section 40. The longitudinal axis B divides the template into an upper section 50 and a lower section 52.

Notch 24 (FIG. 1) is constructed by the cooperation of a right side retention nut opening 24A and a left side retention nut opening 24B in upper section 50 of template 11. These openings 24A and 24B are spaced equidistance apart from the transverse axis A and are separated by the partition wall 36 between the openings 24A and 24B. U.S. Pat. No. 6,257,565B1 discloses a prior art clamp blank with a single, elongated notch. Thus it is possible to retrofit such prior art blanks for use with the present invention by spot-welding or otherwise providing a partition wall centered in the notch.

The clamping cavity 18 is formed by a large opening 18A in a central section 54 of the template 11. The shape of opening 18A is symmetrical about the longitudinal and transverse axis of the template. As will be understood below, the folding of the template creates side walls 38 and 40, clamping cavity 18, and notch 24. The lower opposing arm 16 is formed by the folding of the raised tab 16A while the inner, upper edge 14A of the opening 18A forms the upper opposing arm 14.

Figure 3:
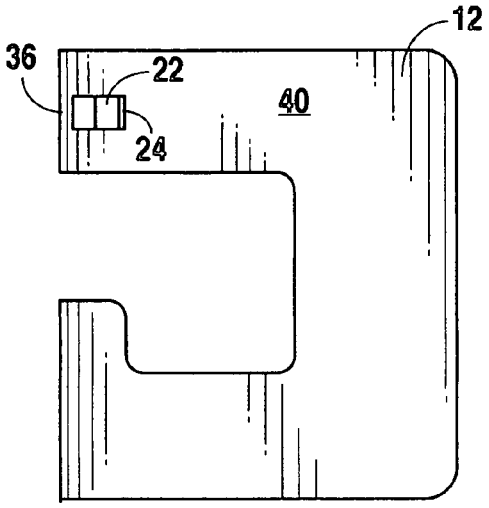
FIG. 3 illustrates a left side, elevation view of the folded housing of the present invention with the secured retention nut in place.

Thus, the clamp 10 of the present invention is made by bending, folding, or molding the template 11 along the transverse axis A into the C-shaped clamp 10 shown in FIG. 3. It will be understood that as the template is folded into sides 38 and 40, flat face 22A of nut 22 may be placed against the rear side of partition wall 36 with outer nut diameter and nut edges 22B and 22C extending through openings 24A and 24B, respectively. Once the sides 38 and 40 are folded to a width W between the sides (which is less than the outer nut diameter D), the nut 22 is secured within the notch 24 and will not rotate or pop out (see FIG. 4).

Figure 5:
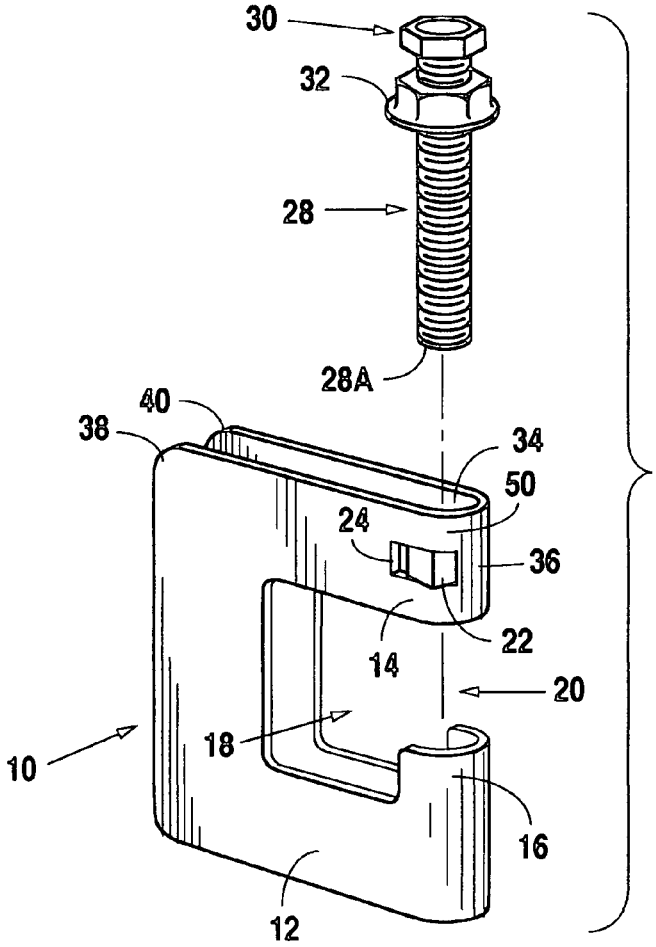
FIG. 5 illustrates an exploded perspective of the present invention with the fastener member ready for insertion into the clamp housing.

Turning now to FIG. 5, it may be seen that fabrication of the clamp 10 is completed by passing the threaded fastener 28 through a channel 34 in the upper section 50 of the folded C-shaped clamp 10 and then threading the fastener through the secured nut 22. By proper threading, the head 28A of member 28 forms a variable gap opening 20 in the cavity 18. The width G of the gap corresponds to the degree of rotation of the threaded member 28 through the nut 22 and the distance of the head 28A from the lower opposing arm 16.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

What is claimed is:

1. A decking clamp for use in an underhung roof system comprising:

a substantially C-shaped housing having first and second opposed arms and a clamping cavity with a variable gap opening to said cavity;

a threaded retention nut having an outer diameter dimension secured within a two opening notch in a front section of said first opposed arm; and said two opening notch further comprises a generally vertical partition wall between opposite sides of said notch, thereby forming opposed openings in said front section, said retention nut having outer edges extending through said opposed openings and retained therein rearward said partition wall when opposite side walls of said housing are spaced apart a distance less than said outer diameter dimension of said nut; and a threaded fastener member extensible through said housing and said threaded retention nut, said fastener member rotatable through said nut to vary the width of said variable gap opening between said first and second opposed arms.

* * * * *